United States Patent [19]

Estrada

[11] Patent Number: 4,460,420

[45] Date of Patent: Jul. 17, 1984

[54] METHOD AND ARTICLES FOR REPAIRING GYPSUM WALLBOARD

[75] Inventor: Paul Estrada, Mesquite, Tex.

[73] Assignee: Sylver National Industries, Inc., Arlington, Va.

[21] Appl. No.: 420,474

[22] Filed: Sep. 20, 1982

Related U.S. Application Data

[62] Division of Ser. No. 178,959, Aug. 18, 1980, abandoned.

[51] Int. Cl.[3] ..... B32B 35/00

[52] U.S. Cl. ..... 156/64; 29/402.11; 52/514; 156/71; 156/92; 156/98; 156/152; 206/582; 264/36; 428/63; 428/99; 428/132; 428/138; 428/223

[58] Field of Search ..... 264/36; 29/402.11; 206/582; 52/514; 427/140; 428/63, 138, 99, 223, 132; 156/64, 98, 71, 152, 92, 153

[56] References Cited

U.S. PATENT DOCUMENTS

| | | | |
|---|---|---|---|
| 1,669,541 | 5/1928 | Spreen | 52/514 |
| 1,791,337 | 2/1931 | Wendell | 411/466 |
| 1,856,030 | 4/1932 | Loeffler | 52/DIG. 6 |
| 2,234,701 | 3/1941 | Lyman | 52/417 |
| 2,370,594 | 2/1945 | Turk | 52/515 |
| 2,552,114 | 5/1951 | Reinhard | 428/99 |
| 2,638,774 | 5/1953 | Wieman | 52/514 |
| 3,029,173 | 4/1962 | Reinhard | 428/223 |
| 3,086,328 | 4/1963 | Peterson | 52/417 |
| 3,874,505 | 4/1975 | Mirarchi et al. | 206/582 |
| 4,122,222 | 10/1978 | Parker | 428/63 |
| 4,135,017 | 1/1979 | Hoffmann | 52/514 |

FOREIGN PATENT DOCUMENTS

| | | | |
|---|---|---|---|
| 858168 | 12/1970 | Canada | 52/288 |

*Primary Examiner*—John J. Gallagher

*Attorney, Agent, or Firm*—Hubbard, Thurman, Turner & Tucker

[57] ABSTRACT

Plaster core laminated wallboard is repaired or finished with a repair article comprising a substantially rigid steel plate having integral teeth forcibly insertable into the wallboard to hold the article in place over the damaged area, and a flexible cover portion formed of wallboard facing paper overlapping the edges of the plate and bonded thereto. The thickness of the paper cover portion may be tapered toward the outer edges thereof to form a smooth transition from the cover portion to the existing wallboard surface. Holes in the plate near the edges or corners thereof provide for increased contact of wallboard repair compound with the paper cover portion. The article may be formed in different configurations for covering plumbing openings, exterior corners and elongated stress cracks or seams.

The wallboard is repaired by cutting a recess into and through the paper surface lamination of said wallboard to the outline of the plate portion of the repair article. The facing paper layer of the wallboard may also be cut to the outline of the cover portion of the repair article to provide for recessing the cover portion also.

A repair kit is provided for performing the method of wallboard repair and comprising one or more repair articles, a cutting tool for cutting the outline of the repair article into the wallboard surface lamination, a scraper for forming a recess in the wallboard around the damaged area by removing core material to a predetermined depth and a portion of wallboard joint or finishing compound for adhesively bonding the repair articles to the wallboard.

10 Claims, 9 Drawing Figures

METHOD AND ARTICLES FOR REPAIRING GYPSUM WALLBOARD

This application is a division of application Ser. No. 178,959, filed: Aug. 18, 1980, now abandoned.

BACKGROUND OF THE INVENTION

1. Field of the Invention

The invention pertains to a method and articles for repairing and finishing gypsum wallboard and the like.

2. Description of the Prior Art

Gypsum or plaster wallboard is widely used in residential and commercial buildings for interior wall construction. Although gypsum wallboard is relatively inexpensive and easy to install in new interior building construction or remodeling it is easily damaged when impacted and is somewhat difficult to repair when cracked or punctured.

A variety of techniques and articles have been developed for repairing holes and cracks in gypsum wallboard. One well known method involves simply filling the hole with a backing of paper, rags or wire mesh and overlaying the backing with a patching compound. This method is generally undesirable because it is difficult to hold the backing material in place during repair operations. Moreover, the repaired portion of the wall usually remains structurally weaker than the undamaged wall portion.

Several inventions in the art of repair of wallboard have been developed which are generally characterized by mechanical devices which are foldable or collapsible so that they may be inserted through the hole to be repaired and then opened to form a backing surface to support the application of a patching compound. U.S. Pat. Nos. 2,598,194; 2,638,774; 2,997,416; 3,325,955; 3,583,122; 3,690,084; 3,874,505; and 4,100,712 disclose various types of devices which provide a backing for repairing a hole in wallboard. Not only are such devices generally somewhat complicated and expensive but the repair of a wall by filling the hole with patching compound is time consuming and requires two or more time spaced visits to the work site to complete the repair process.

It has also been proposed to provide prepared patches of various sizes which may be applied directly over the hole or indentation in the wallboard. U.S. Pat. No. 4,122,222 to Parker discloses a wallboard repair patch which is placed directly on the wallboard surface to cover the hole or other damage thereto. The repair patch disclosed in the patent to Parker comprises a layer of plaster or wallboard finishing compound laminated to a sheet backing member. The patch itself is not structurally rigid or strong enough to form the only means covering the hole, and, accordingly, a plug of wallboard material must be inserted in the hole and fixed therein before the patch is applied. In most instances the hole must first be dressed to accept a plug insert having a simple geometric shape for ease of insertion.

U.S. Pat. No. 4,135,017 to Hoffmann also discloses a repair patch adapted to be applied directly to the surface of the wallboard over the hole or damaged area. The patch disclosed in the Hoffmann patent is precoated with an adhesive for holding the patch in position over the damaged area of the wallboard.

The method and patches disclosed in the Hoffman and Parker patents do not provide for a repair which leaves the wall surface substantially flat and smooth. As is well known to those skilled in the art any interruption of the wallboard surface may show through certain wall coverings particularly if such coverings are provided with a gloss or otherwise highly reflective surface. The patches disclosed in the aforementioned patents as well as other prior art methods of wallboard surface preparation require repeated operations of applying wallboard joint or patching compound and sanding after drying in an effort to provide an uninterrupted surface. The method and articles provided for gypsum wallboard repair heretofore known have not successfully reduced the number of operations nor the time required to complete the wallboard repair process due to the need to make repeated visits to the repair worksite in order to provide a substantially smooth wall surface.

A further problem in the art of repair of gypsum wallboard or the like is concerned with the strength of the repaired section. In many instances the initial cause of the damage may be due to localized impacts which are likely to recur after repair. Accordingly, it is desirable that the repair patch be somewhat stronger than the original wall surface. In this regard, substantially all of the known patching methods and materials fail to provide the structural strength and rigidity desired together with the provision of a surface which will absorb some impact without causing cracking or flaking off of the surface coating.

The problems associated with known methods and materials for repairing gypsum wallboard or the like are substantially overcome by the method and articles provided by the present invention.

SUMMARY OF THE INVENTION

The present invention provides an improved method and articles for repairing gypsum wallboard and the like; wherein a hole or crack may be repaired with a patch element which will leave a substantially smooth uninterrupted wall surface, is structurally stronger and more resistant to damage from further impact than the original wall, and requires only one brief visit to the work site to complete the repair process.

The present invention contemplates a wallboard repair patch article which is easily applied to the damaged area of the wall, is structurally strong, and is economical to manufacture and use in the completion of the repair process.

The improved repair patch of the present invention comprises a metal plate preferably of rust preventative coated sheet steel which is bonded to a backing of paper or the like which overlaps the edges of the plate sufficiently to be used as a tape or backing which may be bonded to the wall surface. In a preferred form of the present invention the repair patch uses the same paper as is normally used as the facing paper in conventional gypsum wallboard.

One advantage of the repair patch of the present invention is that it is adapted to be used in conjunction with wallboard joint or finishing compound also known in the trade as "mud" and, accordingly, no special adhesives are required to be used on or in conjunction with the patch.

The wallboard repair patch of the present invention is advantageously provided with tangs or teeth which are conveniently formed on the metal plate portion of the patch and are operable to anchor the patch to the wall in position over the area to be repaired. The repair patch of the present invention is also provided with openings through the metal plate to allow for the wallboard joint compound to fill the openings and come into contact with the paper backing to increase the adhesion of the patch to the wallboard.

The wallboard repair patch of the present invention may be provided in a variety of configurations including preferred shapes for repair of elongated cracks, providing close fitting closures around piping or other objects which project from the wall surface, and for covering exterior corner damage or wall joints in new construction.

The present invention also provides an improved method of repairing wallboard wherein a substantially smooth surface is formed which may be completely co-planar with the original wall surface. In one preferred method according to the present invention a novel repair patch comprising a metal plate backed by a smooth paper backing is selected to cover the damaged area in its entirety. The patch is applied over the damaged area and the outline of the metal plate portion of the patch is cut into the paper surface of the wallboard. The patch is temporarily removed and the wallboard surface paper is then removed down to the plaster or gypsum core. A novel scraper, also according to the present invention, is used to remove the core material to a depth controlled by the length of a plurality of serrations or teeth on the scraper. Wallboard joint or finishing compound is then applied over the prepared recess as well as the surrounding area of the wall surface at least to cover an area as large as the area of the paper backing of the patch. The patch is then applied over the recess and pressed thereinto. A small amount of joint compound may then be applied around the edges of the paper backing to blend the paper smoothly into the surrounding wall surface. This embodiment of the method in accordance with the present invention is entirely suitable for walls which are to be textured on final finishing.

A second method for repairing gypsum wallboard in accordance with the present invention provides for removal of the wallboard paper down to the gypsum core to the outline of the metal plate portion of the patch, said method further provides for removal of only the face paper layer of the wallboard to the outline of the paper backing of the repair patch. Accordingly, after application of joint compound to the entire area of the wall which has been recessed, including the portion over which only the facing paper has been removed, the patch is applied to the recess and smoothed down with a trowel or putty knife in a conventional manner. The second embodiment of the method of wallboard repair in accordance with the present invention is therefore suitable for entirely smooth and untextured wall surfaces.

The present invention still further provides an improved template or cutter for determining the outline of the metal plate as well as the paper backing of the repair patch on the wall surface. The wallboard repair cutter according to the present invention is provided with serrations all along the exterior edges thereof which correspond to the outline of the paper backing of the repair patch. The cutter according to the present invention also includes serrations along the edges of an opening in the template which corresponds to the outline of the metal plate portion of the repair patch.

Accordingly the cutter of the present invention may be used in conjunction with the second embodiment of the method of repairing gypsum wallboard according to the present invention.

The present invention still further contemplates a novel kit made up of interrelated articles which may be used to practice the method of wallboard repair in accordance with the present invention. The wallboard repair kit in accordance with the present invention may include all of the elements necessary to carry out the novel method for repairing gypsum wallboard in accordance with the present invention.

As will be appreciated by those skilled in the art, upon reading the detailed description herein in conjunction with the drawings, the interrelated articles of the present invention are advantageously used to carry out the improved method for repairing wallboard, which method is faster and provides for a better finished appearance than heretofore known wallboard repair processes.

BRIEF DESCRIPTION OF THE DRAWINGS

FIG. 5 is a perspective view of a further embodiment of a repair patch according to the present invention which is adapted to form closures around piping and the like;

DETAILED DESCRIPTION OF THE PREFERRED EMBODIMENTS

Figure 1:
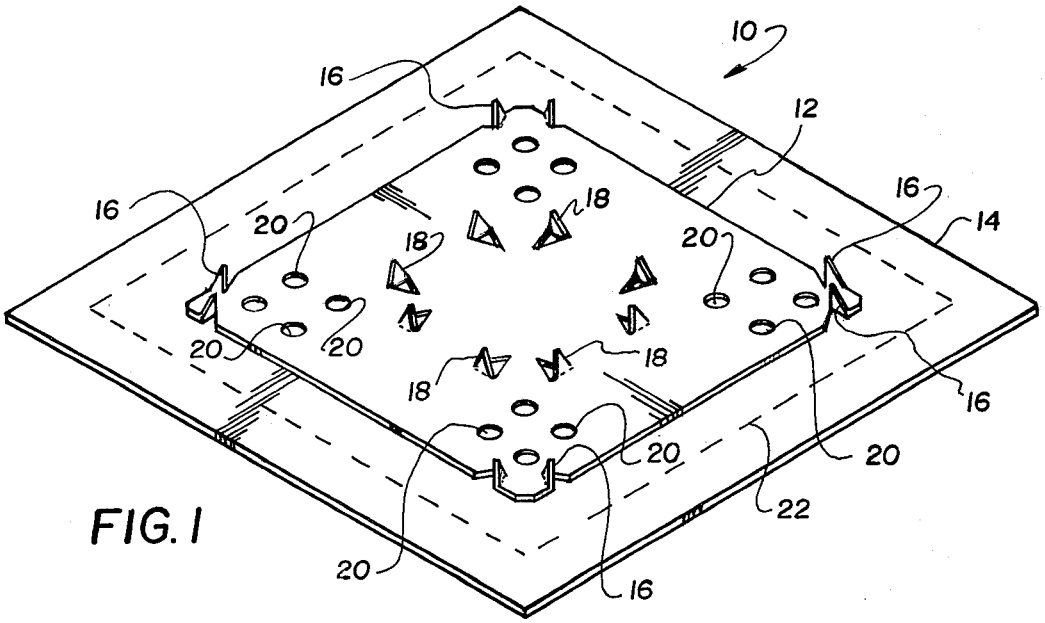
FIG. 1 is a perspective view of an improved wallboard repair patch according to the present invention.

In the description which follows like parts are marked throughout the specifications and drawings with the same reference numerals, respectively.

The drawings are not necessarily to scale and in some instances structural portions have been exaggerated in order to more clearly depict certain features of the invention.

Referring to FIG. 1 there is shown, in perspective, an improved wallboard repair article comprising a patch according to the present invention and generally designated by the numeral 10. The wallboard repair patch 10 is characterized by a rectangular metal plate 12 which is suitably bonded to a rectangular paper backing 14. The plate 12 includes a plurality of tangs or teeth 16 formed along each side of the plate near the intersections of the adjacent sides. The plate further includes a plurality of teeth 18 formed in a suitable square or rectangular pattern and spaced inwardly from the edges of the plate. The plate 12 is further characterized by a plurality of holes 20 which may be formed in a variety of patterns but are advantageously grouped in clusters of four near the corners of the plate. A preferred length or height or the teeth 16 and 20 as measured from the surface 21 of the plate is in the range of 2–6 mm. The plate 12 should be of a thickness which will resist bending and preferably be stronger than the original wall surface for use in repairing damage which is likely to recur. It has been determined that 22 to 28 gauge (i.e., approximately 0.780 mm to 0.390 mm thick) steel plate provides for a suitably strong repair patch. The aforementioned gauge numbers are in reference to U.S. Standard Sheet Metal Gauge designations. The plate 12 is also preferably made of rolled sheet steel which has been galvanized or provided with some other form of rust preventative treatment. It is comtemplated that the plate 12 can be finish formed in one stamping operation to not only cut out the plate to its final shape but also to form the teeth 16 and 18 and the holes 20.

The paper backing or cover 14 of the repair patch 10 is preferably formed of a smooth paper similar to the facing paper used in conventional gypsum wallboard. It is in fact preferred that the paper cover 14 be of the same type of paper as the conventional gypsum wallboard facing paper, such paper is of a thickness of approximately 0.4 mm. The paper cover 14 is desirably dimensioned to extend beyond the edges of the plate 12 approximately 25 mm on all sides. In order to form a smoother transition from the paper cover 14 to the surface of the wallboard in one preferred method of repair according to the present invention the cover is lightly sanded on one or both sides to approximately half of the width of the overlap of the cover with respect to the plate 12 as indicated by the dashed line 22 in FIG. 1. The cover 14 may be sanded on one or both sides to provide feathering or tapering of the thickness of the paper from the line 22 to the outer edges of the cover.

The cover 14 is preferably bonded to the plate 12 with a non water soluble contact cement of the type, for example, which is used to bond metal to cloth in such applications as automobile manufacturing. A preferred type of cement is one made by AIRSCO Adhesives Division under the part number 4830-10.

The repair patch 10 may be provided in a variety of shapes and sizes to provide for repairing various sized damaged areas and for use in finishing new wall construction.

Figure 4:
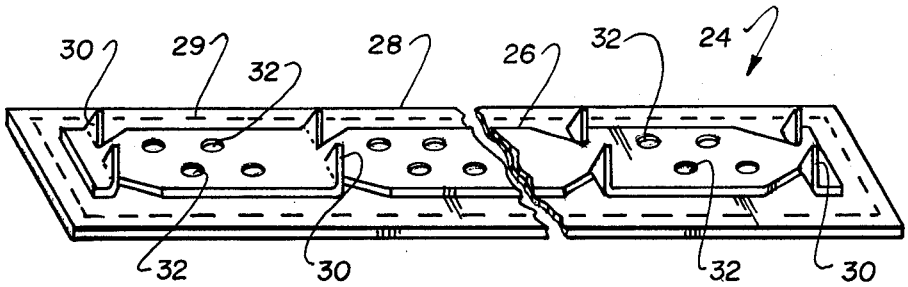
FIG. 4 is a perspective view of an embodiment of the repair patch according to the present invention which is adapted for repair of elongated cracks in wallboard.

Referring to FIG. 4 an alternate embodiment of the present invention comprising a patch particularly adapted for repairing stress cracks in wallboard is illustrated and designated by the numeral 24. The patch 24 includes an elongated metal plate portion 26 and a paper cover 28. The plate 26 includes teeth 30 formed along opposite longitudinal sides of the plate and spaced approximately 25 mm apart. Holes or openings 32 are also desirably formed in the plate 26 to permit joint compound to come into contact with the paper cover within the area delimited by the plate 26. The crack patch 24 is preferably formed so that the metal plate dimensions are approximately 50 mm wide by 750–1000 mm long. The width of overlap of the cover 28 around the edges of the metal plate 26 is desirably the same as for the patch 10 or approximately one-half the width of overlap used for the patch 10. The paper cover 28 may also be sanded to taper the thickness toward the outer edges from the dashed line 29. The materials used for the crack patch 24 may be the same as indicated for the patch 10. The crack patch 24 may be provided in a variety of lengths or cut to length as the crack to be repaired requires.

Figure 5:
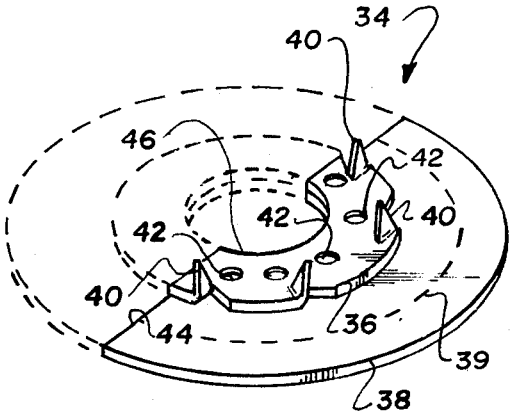

Another embodiment of a repair patch or wallboard finishing article in accordance with the present invention is shown in FIG. 5. The embodiment of FIG. 5 comprises a semi-circular patch element generally designated by the numeral 34. The patch 34 includes a semi-circular metal plate 36 which is bonded to a semi-circular paper cover 38. The plate 36 includes teeth 40 formed along the outer circumference, and a plurality of holes or openings 42 which provide for contact of the wallboard joint compound with the paper cover within the area delimited by the plate. The patch 34 also provides for an overlap of the paper cover with respect to the plate of approximately 25 mm except along the diametral edge 44 wherein the paper is even with the edge of the plate. The plate 36 includes a semi-circular opening 46, the size of which together with the size of the patch 34 may be varied. By using two patch elements 34 abutted against each other along their respective edges 44 suitable closures may be formed at locations where plumbing conduits project from the wall surface. The openings 46 may be dimensioned to form a snug fit around various standard conduit diameters to provide a suitable seal where conduits and the like must project through the wallboard. The materials used in the patch 34 and the method of fabrication of the plate 36 are preferably the same as for the embodiments described hereinabove and shown in the FIGS. 1 and 4. The cover 38 may be sanded to taper the thickness thereof from the dashed line 39 toward the outer peripheral edge of the cover.

Figure 6:
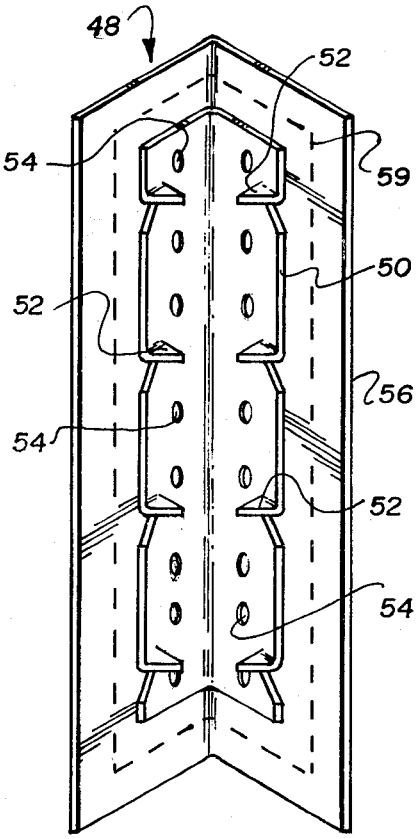
FIG. 6 is a perspective view of yet another embodiment of a repair patch particularly adapted for application to exterior corners.

Still another embodiment of a repair of finishing patch article in accordance with the present invention is shown in FIG. 6 of the drawings. Referring to FIG. 6 there is shown a finishing or repair patch generally designated by the numeral 48 which is particularly adapted for the finishing or repair of exterior corners or intersections. The corner patch 48 includes an elongated metal plate 50 bent relatively sharply along a central longitudinal line. The plate 50 may be provided with stamped teeth 52 and openings 54 both spaced apart along the opposite longitudinal sides of the plate. The functions of the teeth 52 and the openings 54 are the same as for the embodiments shown in FIGS. 1, 4 and 5. The corner patch 48 is also provided with a paper backing or cover 56 which is bonded to the plate 50 and overlaps the edges of the plate to the same degree as the embodiments in FIGS. 1 and 5. The thickness of the paper cover 56 may be tapered or feathered toward the outside edges thereof from the dashed line 59 in the same manner as described for the embodiments of FIGS. 1, 4 and 5. The materials used in the corner patch 48 may be the same as those previously described and used in the embodiments of FIGS. 1, 4 and 5 herein.

The wallboard repair and finishing articles herein described and shown in FIGS. 1, 4, 5 and 6 of the drawings are economical to manufacture, provide a stronger wallboard repair than may be obtained with prior art repair articles or processes, and are advantageously used in connection with an improved method of wallboard repair described hereinbelow.

Figure 2:
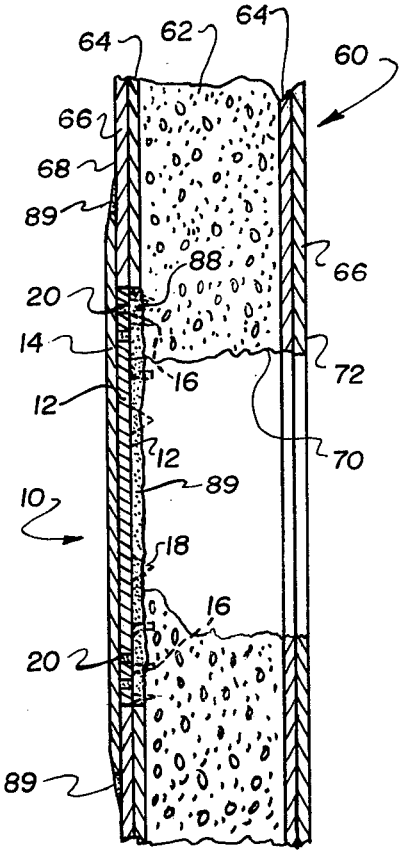
FIG. 2 is a cross-section of a portion of conventional gypsum wallboard or the like showing the application thereto of a repair patch in accordance with one method of repair according to the present invention.
Figure 3:
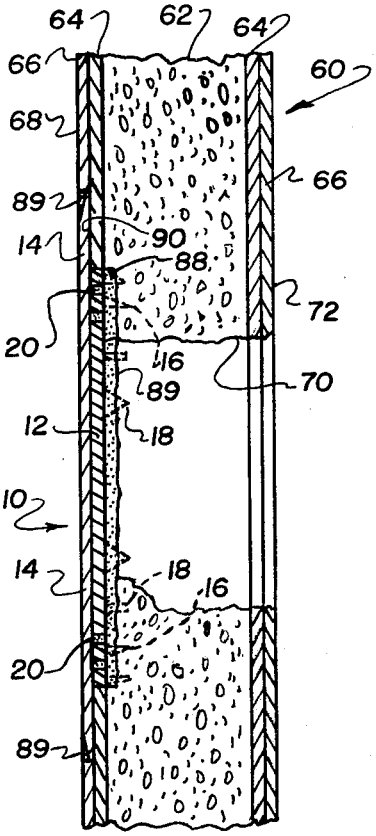
FIG. 3 is a cross section of a portion of gypsum wallboard showing the application thereto of a repair patch in accordance with a second embodiment of a method of wallboard repair in accordance with the present invention.

Referring to FIGS. 2 and 3 of the drawings, a portion of a typical plaster wallboard is shown in cross section and generally designated by the numeral 60. The wallboard 60 may be of the type characterized by a suitable gypsum or other plaster type core 62 sandwiched between paper covering comprising a layer of a relatively coarse backing paper 64 on opposite sides of the core and a layer of a somewhat smoother facing paper 66 covering the coarse backing paper. The surface 68 is designated as the interior wall surface which may be finished by painting, texturing with a thin coat of plaster, or covered with a variety of solid wall coverings.

The general type of wallboard described herein is relatively easily holed os susceptible to surface damage. It is known to repair holes in wallboard such as the hole 70 shown in FIGS. 2 and 3 by filling the hole with one of a variety of finishing or repair compounds which air harden to form a plug in the hole which may be sanded smooth and flush with the surface 68. Generally speaking if the hole is more than approximately 12 mm in diameter some form of solid backing must usually be provided for covering the backside of the hole to hold the repair compound. Even with the assistance of a backing against the surface 72, FIGS. 2 and 3, large holes are difficult to repair because the compound will sag before hardening and also undergo shrinkage and cracking during the hardening process. Accordingly repeated trips to the worksite must be conducted to obtain a suitable repair which is not normally even as strong as the original wallboard structure. If damage to the wall is due to a cause which is likely to recur such as being impacted by a door knob or the like, the repair will be short lived. the wallboard repair illustrated in FIGS. 2 and 3 together with the improved method for making such a repair overcomes the problems associated with previous methods and articles used for wallboard repair and finishing.

In one embodiment of the method of wallboard repair in accordance with the present invention the hole 70 in the wallboard 60 is repaired by application of the patch 10, by way of example. The basic method of repair described herein may also be used in conjunction with the repair or finishing patches illustrated in FIGS. 4, 5 and 6 of the drawings.

Referring particularly to FIG. 2 the hole 70 is prepared for repair by cutting away any jagged or loose pieces of paper and or core material so that the intersection of the hole and the surface 68 is substantially rigid. An area of the surface 68 at least as large as the area of the paper cover 14 of the patch 10, and preferably larger by 10–25 mm in all directions, is sanded to remove paint or other surface coatings or materials from the wallboard facing paper. A patch such as the patch 10 is selected of suitable size such that the metal plate portion of the patch covers the hole 70 entirely and preferably extends beyond the edges of the hole at least 10 to 20 mm in all directions. The patch 10 is then centered over the hole as much as possible and pressed against the surface 68 forcing the teeth 16 and possibly also the teeth 18 into the wallboard. With the patch 10 in place over the hole or damaged area the paper cover 14 is carefully folded back so as not to crease the paper but sufficiently to permit scribing a line on or into the facing paper 66 around the edges of the metal plate 12.

After scribing a line defining the outline of the plate 12 the patch 10 is removed from the wallboard and a sharp knife is then used to cut into the surface 68 along the scribed line at least to the depth of the core 62.

Both layers 64 and 66 of the wallboard paper covering are then removed within the area bounded by the cut.

Figure 8:
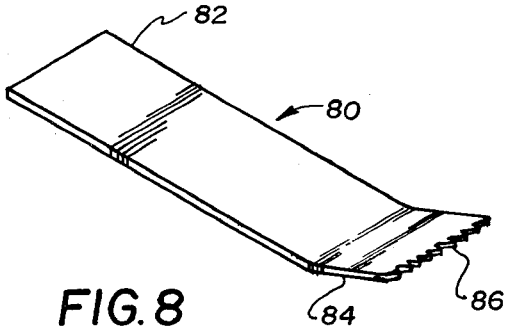
FIG. 8 is a perspective view of an improved tool adapted to form a recess in the wallboard to a preferred depth; and, FIG. 9 is a perspective view of a kit of interrelated articles which may be advantageously used to carry out the method of wallboard repair according to the present invention.

The practice of the improved method of the invention is enhanced by the use of a scraper illustrated in FIG. 8 of the drawings and generally designated by the numeral 80. The scraper 80 may be suitably formed of an elongated rectangular strip of sheet steel of a suitable thickness to resist bending in use and is characterized by a handle portion 82 and a head 84 formed by bending the strip as illustrated. Suitable teeth or serrations 86 are formed across the transverse end of the head 84. The teeth 86 are preferably formed to be of a length corresponding to the depth of a recess 88 to be formed in the core 60 of the wallboard as shown in FIGS. 2 and 3.

When the paper covering on the wallboard 60 has been removed within the area of the aforementioned cut any remaining paper that does not easily peel off the core may be removed along with some core material by use of the improved scraper 80. The length of the scraper teeth assist in controlling the depth of the recess 88.

After the recess 88 is formed and all loose core material is removed from the surface of the recess wallboard joint or finishing compound, designated by the numeral 89, may be liberally applied into the recess as well as to the surface 68 extending in all directions approximately 75 mm beyond the edges of the recess. The patch 10 is then reapplied over and into the recess with finger pressure and pushed into the recess so that the teeth 16 and 18 are firmly set into the core material. The metal plate portion 12 of the patch 10 now extends into the recess as illustrated in FIG. 2. A putty knife or trowel is then used to smooth the patch 10 into place by wiping excess joint compound across the entire exterior face of the paper covering 14 to seat the covering firmly against the facing paper 66 and also blending the very slight edge thickness of the paper cover 14 into the surface 68 of the wallboard. Additional joint compound may be applied to the surface 68 and the exterior surface of the paper covering 14 as required to blend the edges of the cover 14 into the existing wall. The feathered or tapered edges of the cover 14 minimize the requirement to blend the patch into the existing wall and form a substantially imperceptible transition from the existing wall to the exterior surface of the patch. After the joint compound has completely dried the repaired area may be further smoothed or finished with a light sanding operation.

The above described embodiment of the method of the present invention is preferred where an absolutely flat surface 68 is not required such as when a somewhat rough or textured finished wall surface is to be provided or when relatively heavy wall coverings are to be applied over the wall board. Even so, with the use of the smooth facing paper for the cover 14 on the patch 10 with the edges tapered, and the plate 12 recessed, a substantially planar wall surface is provided. The method above described in combination with the improved repair patch of the present invention also provides for a single operating visit to the worksite to produce a complete repair which is stronger than and will resist further damage better than the original wallboard structure.

For wall surfaces which must be absolutely flat a second embodiment of the improved method of wallboard repair according to the present invention may be carried out to produce a repaired area as shown in FIG. 3. In accordance with the method for repairing wallboard as shown by the repaired area in FIG. 3 the first steps in the method described above are carried out in the same manner up to and including the step of scribing the line around the metal plate 12. After scribing the line around the plate 12 the paper cover 14 is held flush against the wall surface 68 and a line is scribed around the outside edges of the cover. The patch 10 is then removed from the area to be repaired and a cut is made into the wallboard 60 along the aforementioned scribed line defining the outline of the metal plate. The aforementioned cut is made to a depth to assure removal of both layers of wallboard paper 64 and 66. The scraper 80 is then employed to remove any paper which does not readily peel off of the core after cutting the outline of the plate 12 and for removal of the core material 62 to form the recess 88.

Further according to the second embodiment of the method a cut is made along the scribed line defining the outline of the patch cover 14. The facing paper 66 is then removed within the area defined by the outline of the cover 14 and the recess 88 to form a second recess 90 having a depth equal to the thickness of the facing paper 66 which corresponds substantially to the thickness of the patch cover 14. The facing paper 66 is normally easily separated from the coarse backing paper layer 64.

Figure 7:
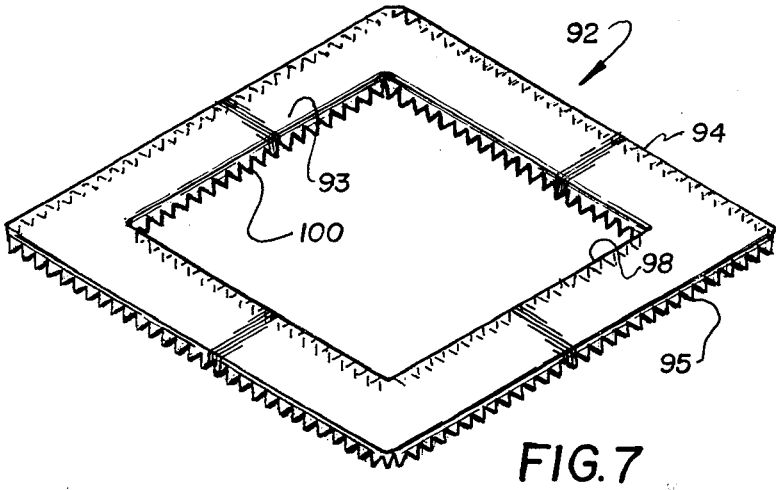
FIG. 7 is a perspective view of a cutter for use in practicing the method of wallboard repair according to the present invention.

Careful control of the depth of cut made in the scribed line defining the outline of the cover 14 will assist in removing only the facing paper layer 66. The process of cutting the outline of the metal plate 12 and the outline of the cover 14 may be enhanced by use of a novel template and cutter illustrated in FIG. 7 of the drawings and generally designated by the numeral 92. The cutter 92 is characterized by a sheet steel plate 93 of a suitable thickness to resist easy bending and is dimensioned to have an outer periphery 94 corresponding to the outline of the patch cover 14. Suitable teeth or serrations 95 are formed on the cutter 92 all around the periphery 94 and projecting perpendicular to the surface of the plate 93. The teeth 95 are preferably formed to have a depth corresponding to the thickness of the facing paper 66. The cutter 92 also includes an opening 98 formed in the plate 93 and having approximately the same dimensions as the outline of the plate 12 of the repair patch 10. The edges defining the opening 98 are also provided with teeth 100 similar to the teeth 96 but which may be longer or deeper to assure cutting completely through both layers of the paper backing of the wallboard.

The cutter 92 may be used in conjunction with the method for repairing wallboard disclosed herein by eliminating the steps of placing the patch over the hole and scribing the outline of the cover and plate on the wallboard. After the damaged area of the wallboard is trimmed as needed and sanded the cutter 92 is centered over the damaged area and pressed firmly into the wallboard to perform the cutting operations required for formation of the recesses 88 and 90. It will be appreciated by those skilled in the art that different sizes of cutters may be provided corresponding to the configurations of the repair patches. Moreover, the cutter may be of a size for cutting the outline of the repair patch metal plate portion only for practicing the first embodiment of the method of wallboard repair according to the present invention.

Figure 9:
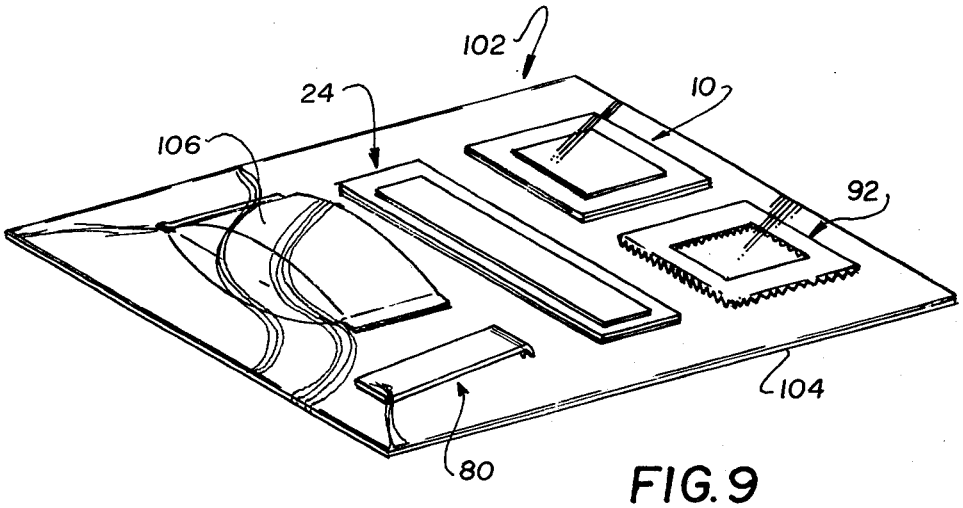

Referring the FIG. 9, the method of wallboard repair in accordance with the present invention may be practiced using a kit of interrelated parts as shown and generally designated by the numeral 102. The kit 102 may be mounted on a skin packaging card 104 or other form of packaging as desired. The kit 102 preferably includes one or more wallboard repair patches 10 and 24, shown for illustration purposes only, one or more cutters 92 corresponding to the most frequently used size of repair patch, for example, a scraper 80, and a container of patching or joint compound 106.

The kit 102 is advantageously used in carrying out the preferred method of wallboard repair and its composition and use make possible the practice of the superior method disclosed herein in an even more efficient manner.

The method of the present invention may be carried out also using the repair patch embodiment shown in FIGS. 4, 5 and 6 as will be appreciated by those skilled in the art. Moreover, other shapes and sizes of repair patches formed with the superior features of the repair patch 10 disclosed herein together with corresponding cutters similar to the cutter 92 may be provided without departing from the scope of the present invention.

What is claimed is:

1. A method for covering a hole or surface indentation in laminated wallboard or the like having a plaster-like core and at least one layer of facing material forming an interior wall surface, said method comprising the steps of:

providing an article for covering said hole or indentation, said article having a substantially rigid plate portion larger than said hole or indentation, and formed of metal plate having a thickness sufficient that the strength of said plate portion is greater than said wallboard, said plate portion including a plurality of teeth projecting perpendicular to the plane of said plate portion and a plurality of spaced apart apertures formed in said plate portion, and a thin flexible cover portion covering said plate portion and said apertures and adapted to form the surface of said wallboard over said plate portion;

defining the peripheral outline of said plate portion on said interior wall surface around said hole or indentation and cutting through said facing material along said outline;

removing said facing material and some core material as required to form a first recess in said wallboard at least as deep as the thickness of said plate portion;

providing wallboard joint compound or the like for adhesively bonding said article to said wallboard and, applying said article to said wallboard and pressing said plate portion into said recess and said cover portion into adhering engagement with said facing material so that at least some of said teeth engage said core around said hole or indentation and said apertures receive said joint compound for adhesive contact with said cover portion.

2. The method set forth in claim 1 wherein:

the step of defining said outline of said plate portion comprises pressing said article into engagement with said wallboard over said hole or indentation, folding said cover portion away from said wall surface to expose the peripheral edges of said plate portion, and scribing a cut line on said wall surface around the peripheral edges of said plate portion.

3. The method set forth in claim 1 together with the steps of:

defining the peripheral outline of said cover portion of said article on said wall surface;

cutting into said facing material along said outline; and, removing said facing material to form a second recess having a depth at least equal to the thickness of said cover portion of said article.

4. The method set forth in claim 3 together with the step of applying said compound to said second recess.

5. The method set forth in claim 4 wherein:

the step of pressing said plate portion into said first recess includes pressing said cover portion into said second recess.

6. The method set forth in claim 3 wherein:

the step of cutting the outline of said plate portion is performed by providing a cutter having cutting edge means defining the outline of said plate portion; and performing the step of cutting said outline in its entirety by pressing said cutter into said wallboard around said hole or indentation.

7. The method set forth in claim 6 wherein:

said cutter includes cutting edge means defining the outline of said cover portion of said article, and the steps of cutting said outline of said plate portion and said cover portion are performed simultaneously by pressing said cutter against said wall surface.

8. The method set forth in claim 1 wherein:

said wallboard joint compound is applied to said recess and said facing material surrounding said recess over an area at least as large as defined by the area of said cover portion.

9. The method set forth in claim 8 together with the steps of:

squeezing excess wallboard joint compound from between said cover portion and said facing material; and, wiping excess compound from said facing material around the periphery of said cover portion to form a surface substantially co-planar with said surface of said wallboard.

10. A method for covering a hole or surface indentation in laminated wallboard or the like having a plaster-like core and at least one layer of facing material forming an interior wall surface, said method comprising the steps of:

providing an article for covering said hole or indentation, said article having a substantially rigid plate portion larger than said hole or indentation and having the rigidity of rolled sheet steel with a thickness in the range of 0.390 to 0.780 mm, and a thin flexible cover portion adapted to form the surface of said wallboard over said plate portion;

defining the peripheral outline of said plate portion on said interior wall surface around said hole or indentation by pressing said article into engagement with said wallboard over said hole or indentation, folding said cover portion away from said wall surface to expose the peripheral edges of said plate portion, scribing a cut line on said wall surface around the peripheral edges of said plate portion, and cutting through said facing material along said outline;

removing said facing material and some core material as required to form a first recess in said wallboard at least as deep as the thickness of said article;

defining the peripheral outline of said cover portion of said article on said wall surface;

cutting into said facing material along said outline;

removing said facing material to form a second recess having a depth at least equal to the thickness of said cover portion;

providing wallboard joint compound or the like for adhesively bonding said article to said wallboard and applying said compound to said second recess; and applying said article to said wallboard and pressing said plate portion into said first recess and said cover portion into said second recess in adhering engagement with said compound.

* * * * *